US008991379B2

(12) United States Patent
Tseng

(10) Patent No.: US 8,991,379 B2
(45) Date of Patent: Mar. 31, 2015

(54) FIRING APPARATUS FOR AN AIRSOFT GUN

(71) Applicant: Ying-Jung Tseng, New Taipei (TW)

(72) Inventor: Ying-Jung Tseng, New Taipei (TW)

( * ) Notice: Subject to any disclaimer, the term of this patent is extended or adjusted under 35 U.S.C. 154(b) by 110 days.

(21) Appl. No.: 13/947,026

(22) Filed: Jul. 20, 2013

(65) Prior Publication Data

US 2015/0020787 A1 Jan. 22, 2015

(51) Int. Cl.
*F41B 11/00* (2013.01)

(52) U.S. Cl.
CPC ..... *F41B 11/00* (2013.01)
USPC ..... 124/73

(58) Field of Classification Search
CPC ..... F41B 11/60–11/64; F41B 11/68–11/682; F41B 11/70; F41B 11/72–11/73
USPC ..... 124/56, 60–61, 63–66, 69–75
See application file for complete search history.

(56) References Cited

U.S. PATENT DOCUMENTS

| | | | | |
|---|---|---|---|---|
| 5,280,778 | A * | 1/1994 | Kotsiopoulos | 124/73 |
| 5,769,066 | A * | 6/1998 | Schneider | 124/75 |
| 6,470,872 | B1 * | 10/2002 | Tiberius et al. | 124/74 |
| 6,925,997 | B2 * | 8/2005 | Sheng | 124/74 |
| 2003/0005918 | A1 * | 1/2003 | Jones | 124/70 |
| 2006/0124118 | A1 * | 6/2006 | Dobbins | 124/77 |
| 2007/0163564 | A1 * | 7/2007 | Gan | 124/73 |
| 2009/0241931 | A1 * | 10/2009 | Masse | 124/76 |
| 2011/0232618 | A1 * | 9/2011 | Gabrel | 124/73 |

* cited by examiner

*Primary Examiner* — Troy Chambers
*Assistant Examiner* — Benjamin Gomberg

(57) ABSTRACT

A device for controlling the firing of an airsoft gun is provided with a valve under a butt. Pressurized air from a high pressure air canister is directed to a rear section of a chamber in the butt. Opening of a valve directs the pressurized air further into a front section of the chamber via the valve so as to bring a plastic pellet to a ready to fire position. Closing of the valve causes pressurized air in the chamber to push a plunger forward to fire the plastic pellet.

1 Claim, 9 Drawing Sheets

FIRING APPARATUS FOR AN AIRSOFT GUN

BACKGROUND OF THE INVENTION

1. Field of the Invention

The invention relates to airsoft guns and more particularly to a firing apparatus for an airsoft gun.

2. Description of Related Art

Airsoft guns use an expanding gas, such as compressed air or carbon dioxide ($CO_2$) to propel plastic pellets through the barrel. Airsoft guns can fire in rapid succession a relatively large number of plastic pellets in a short period of time. A magazine stores the plastic pellets until the balls are delivered to the gun firing chamber. The guns use compressed gas as the propellant, and are usually triggered by a user squeezing a conventionally shaped gun trigger. When the gun user repeatedly squeezes the trigger, the gun should continue to fire plastic pellets as rapidly as possible. Airsoft guns most are either semi-automatic, where each time the trigger is pulled a plastic pellet is fired, or fully automatic, where the balls are fired as quickly as the gun is capable of for as long as the trigger is pulled.

Plastic pellets are relatively round and have an exterior formed from a semi-rigid gelatinous compound. The gelatinous compound is known to be affected somewhat by variables such as temperature and relative humidity. During a firing sequence, plastic pellets on occasion lodge against each other or other objects and block the passageway to the firing chamber, resulting in a jam. While jamming is not new, knowledge from explosive munitions magazines is of little use with the very different plastic pellets.

The invention described below aims to minimize jams when using an airsoft gun.

SUMMARY OF THE INVENTION

It is therefore one object of the invention to provide an apparatus for controlling the firing of an airsoft gun comprising, in combination a butt including a chamber; a first line including a first port communicating with a high pressure air canister releasably secured to an underside of the butt, and a second port communicating with a rear section of the chamber; a valve disposed under the butt and including a stem and a third port; a second line communicating with the first port and the third port; a third line communicating with the third port and a fourth port in the butt; a firing mechanism disposed in the chamber and including a sleeve and a plunger; a trigger operatively connected to the stem; an annular intermediate member of the plunger positioned in the intermediate cylinder; a stop member disposed on an intermediate portion of the plunger; an annular fourth flange disposed in a rear portion of the plunger; a rear annular first flange of the sleeve disposed on an intermediate cylinder in the chamber; a first portion and a second portion adjacent to the first portion disposed in the rear section of the chamber; a push rod disposed in a front portion of the chamber; and a circular member formed at a forward end of the sleeve and releasably secured to the push rod; wherein in a pressurized air supplying operation pressurized air leaving the high pressure air canister flows to the rear section of the chamber via the first line and a forward section of the chamber via the second line, the third port, the third line, and the fourth port respectively; the rear annular first flange of the sleeve is pushed rearward by the pressurized air in the forward section until being stopped by an annular second flange in a rear end of the intermediate cylinder; the pressurized air flows to an annular third flange of the plunger to push the plunger rearward via a fifth port of the sleeve and an orifice of the intermediate cylinder; the pressurized air leaving the rear section of the chamber flows to an adjacent reservoir; the plunger is stopped from moving rearward when the pressurized air reaches the intermediate member of the plunger; and a plastic pellet brought to a front end of the chamber; and wherein in a firing operation a pressing of the trigger pushes the stem rearward to close the valve and block the second line so that a portion of the pressurized air in the chamber and the pressurized air in the third line exit the valve via the third port; the pressurized air in the rear section of the chamber pushes the plunger forward until the second port is blocked by the first portion; the pressurized air in the reservoir passes through a plurality of orifices in the fourth flange to reach a tunnel in front of the plunger; the pressurized air enters a tunnel in the intermediate cylinder; the pressurized air pushes both the push rod and the sleeve forward; the plastic pellet is pushed to a ready to fire position in front of the chamber by the pressurized air passing through a space around the push rod and a plurality of holes through the circular member; and the pressurized air propels the plastic pellet out of the butt to fire.

The above and other objects, features and advantages of the invention will become apparent from the following detailed description taken with the accompanying drawings.

DETAILED DESCRIPTION OF THE INVENTION

Figure 1:
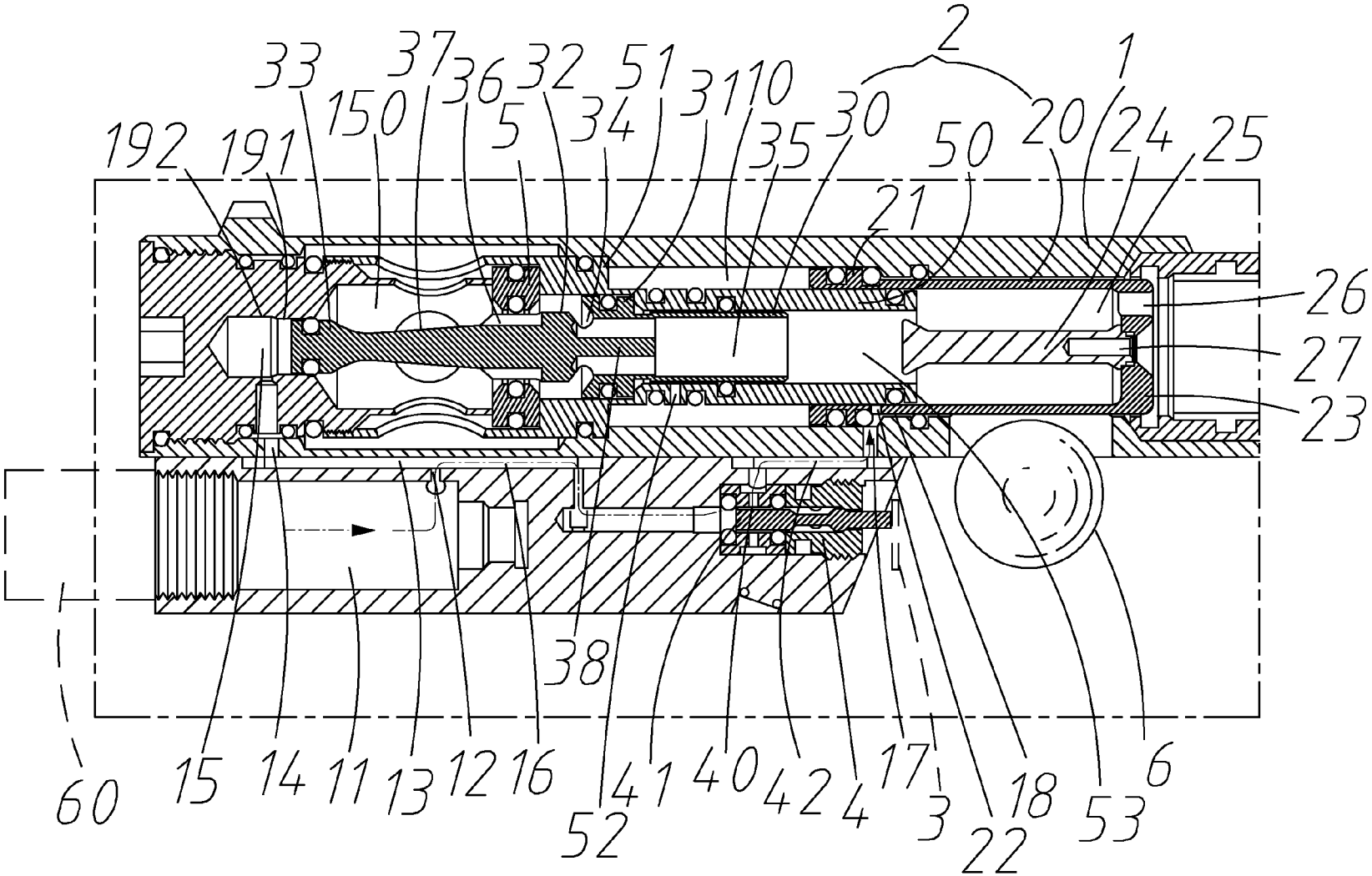
FIG. 1 is a longitudinal sectional view of a firing mechanism in a butt and adjacent portions of an airsoft gun according to the invention, where pressurized air has not supplied to the firing mechanism.
Figure 2:
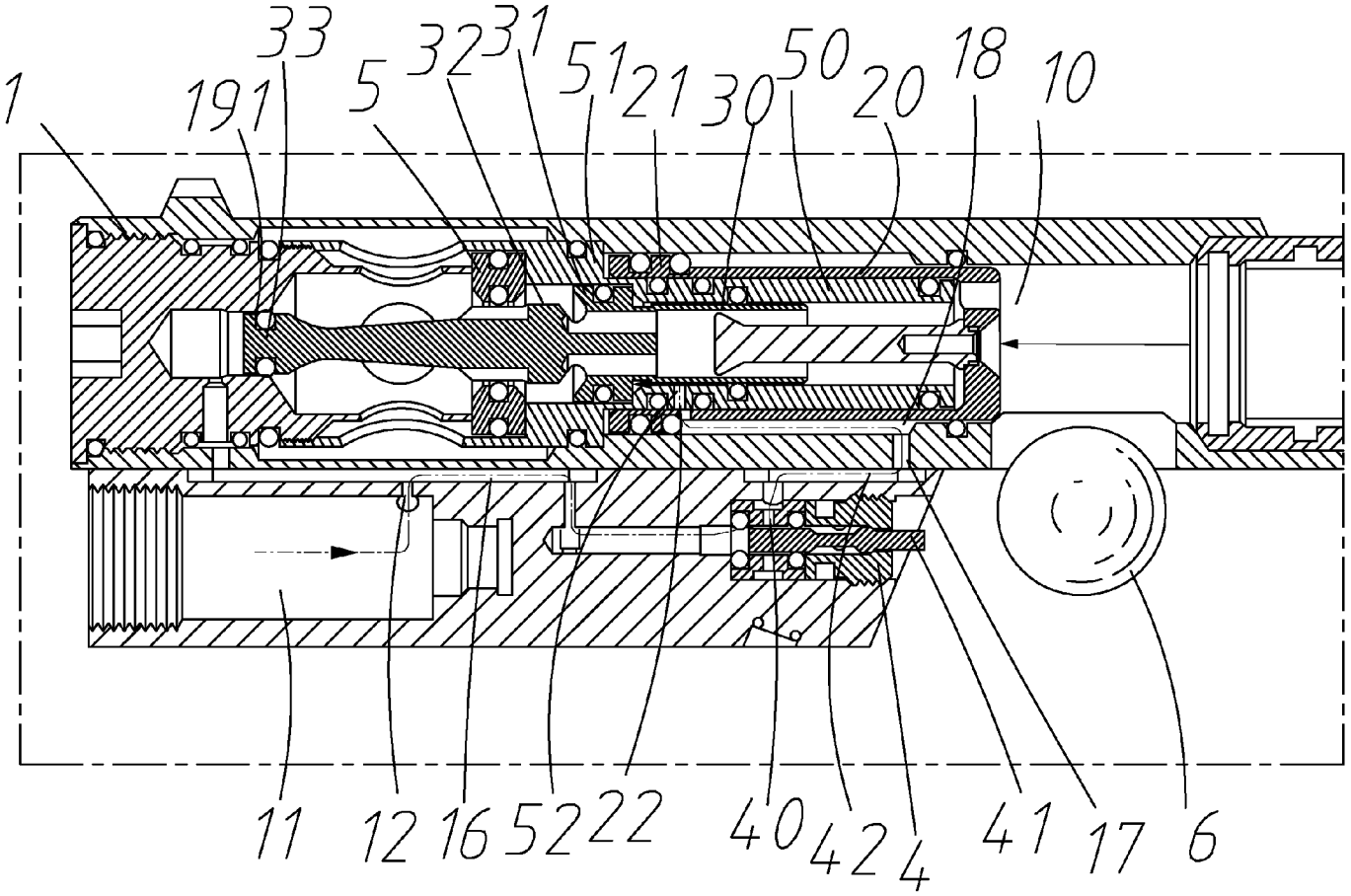
FIG. 2 is a view similar to FIG. 1 where the firing mechanism moves rearward.
Figure 3:
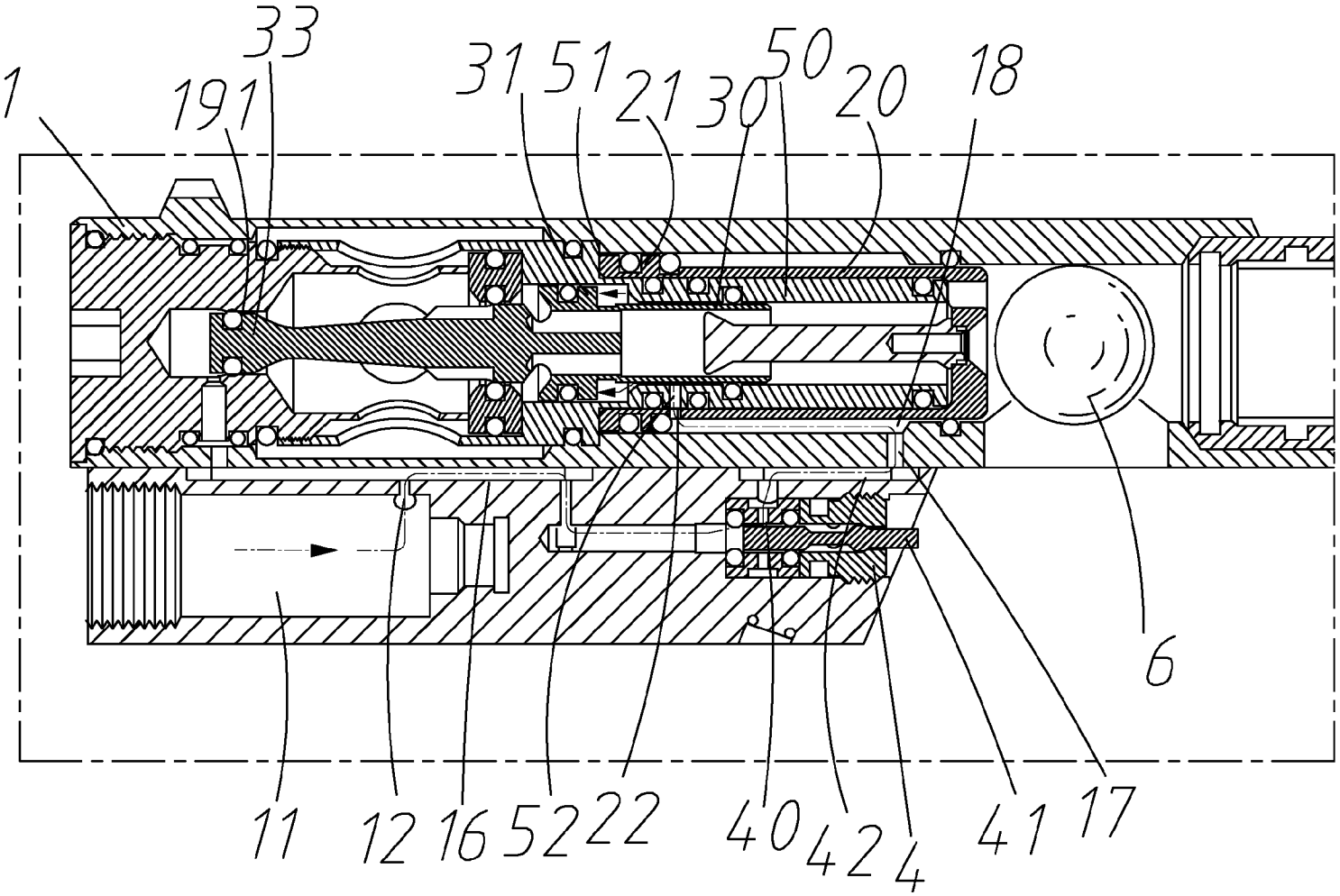
FIG. 3 is a view similar to FIG. 2 where the plastic pellet is disposed in a ready to fire position.
Figure 4:
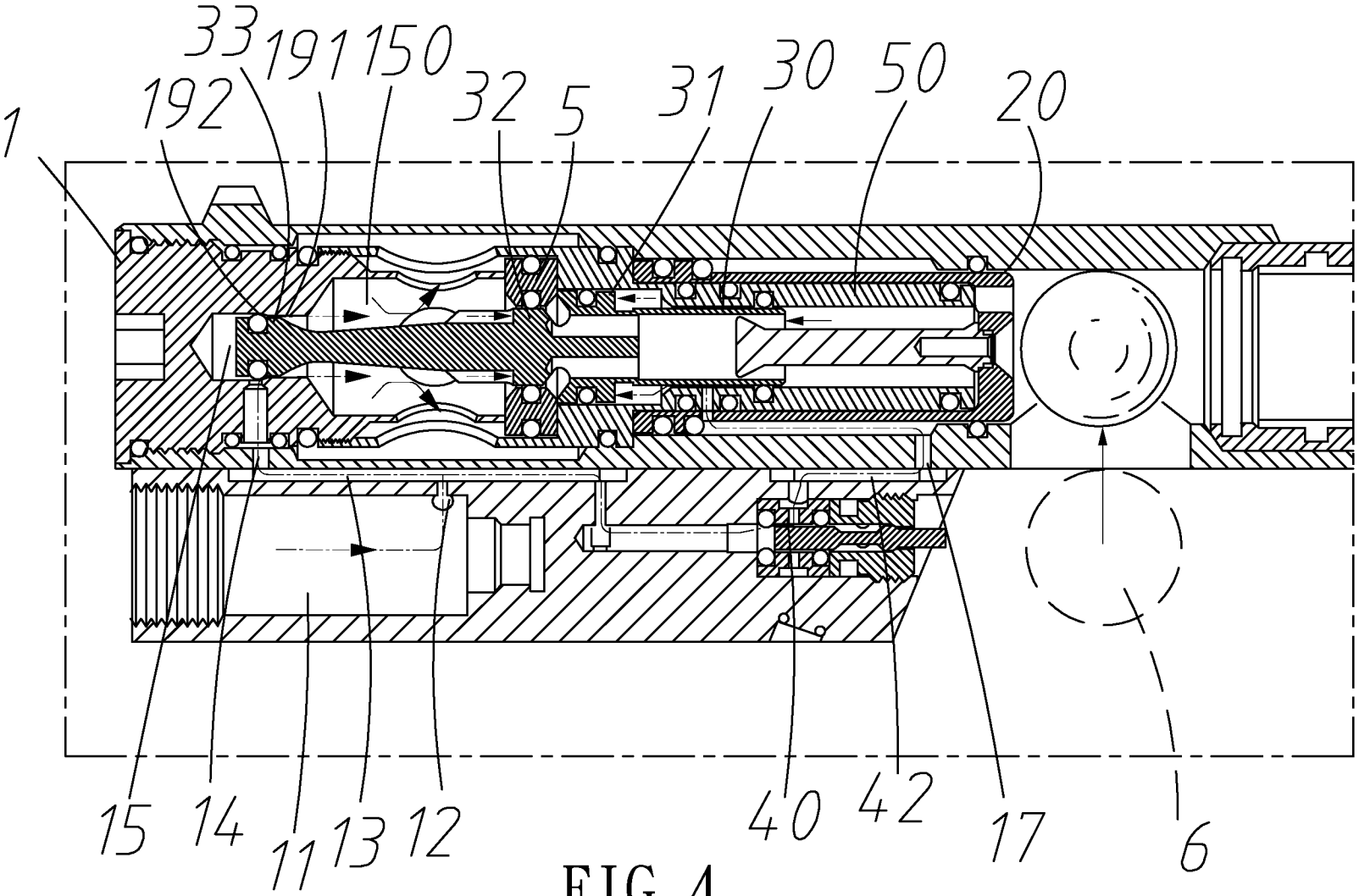
FIG. 4 is a view similar to FIG. 3 where pressurized air flows into the chamber and the stem moves rearward.
Figure 4A:
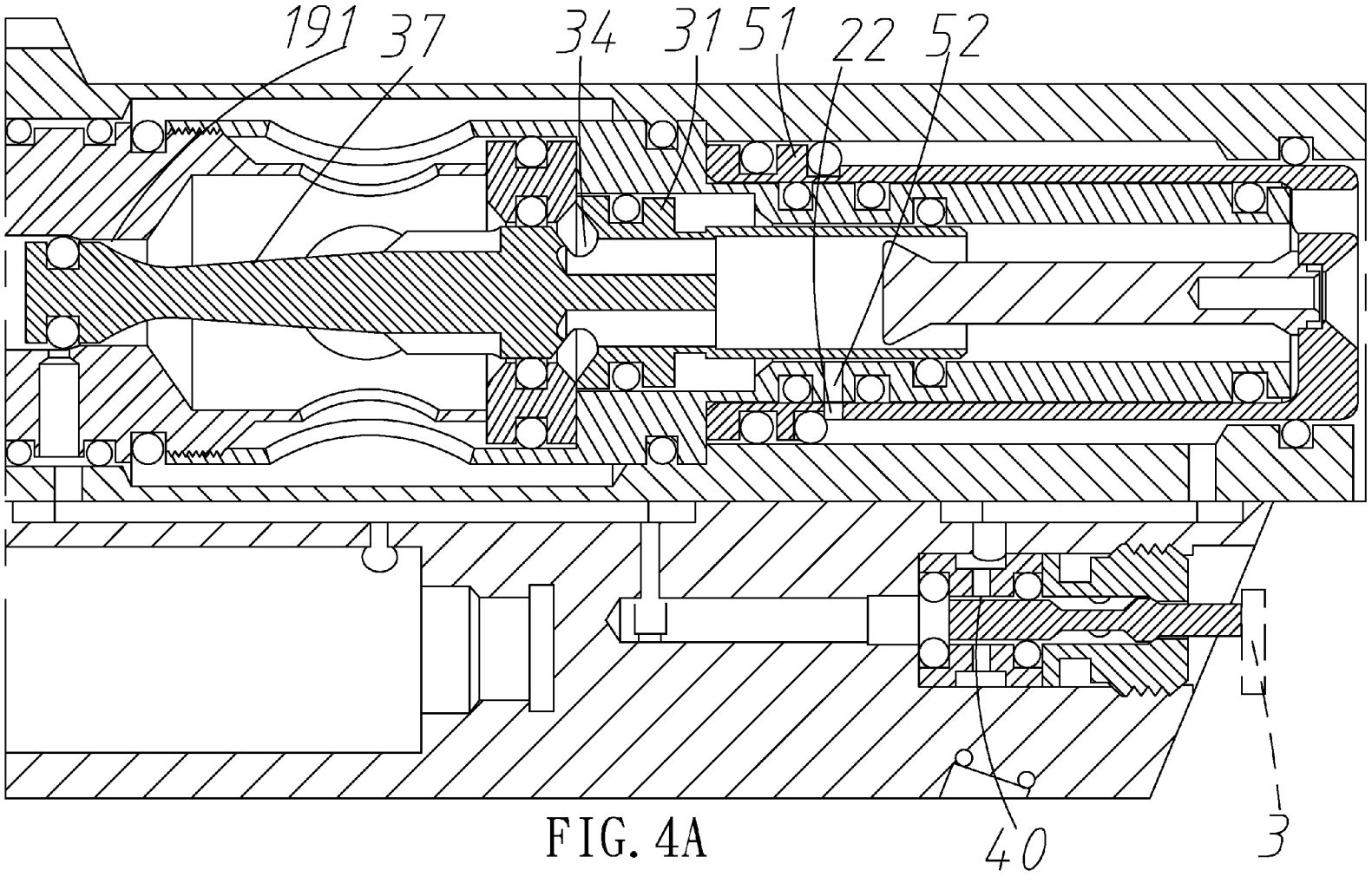
FIG. 4A is an enlarged view of FIG. 4.

Referring to FIGS. 1 to 8, an airsoft gun in accordance with the invention comprises the following components as discussed in detail below.

A butt 1 comprises a chamber 10. One of a plurality of plastic pellets 6 is shown in an underside of the chamber 10. A firing mechanism 2 is provided in the chamber 10 and comprises a sleeve 20 and a plunger 30. A valve 4 is provided under the butt 1. A space 11 is provided under the butt 1 besides the valve 4 and communicates with a high pressure air canister 60.

In a pressurized air supplying operation, pressurized air leaving the air canister 60 flows to the space 11 and then flows to a rear section 15 of the chamber 10 via a port 12, a rear line 13, and a port 14 sequentially. A forward line 16 interconnects the port 12 and the valve 4 and communicates with both. The valve 4 has a stem 41 facing the forward line 16. A trigger 3 is operatively connected to the stem 41 when the stem 41 is pushed forward to its maximum extent by pressurized air flowing from the forward line 16. Pressurized air flows to a forward section 18 of the chamber 10 via a port 40, a channel 42, and a port 17 in the butt 1. A rear annular first flange 21 of the sleeve 20 is provided on an intermediate cylinder 50 in the chamber 10 and is pushed rearward by pressurized air passing the port 17. The rearward movement of the first flange 21 is stopped by an annular second flange 51 in a rear end of the intermediate cylinder 50. Pressurized air then flows to an annular third flange 31 of the plunger 30 to push the plunger 30 rearward via a port 22 of the sleeve 20 and an orifice 52 of the intermediate cylinder 50. An annular intermediate member 32 of the plunger 30 is positioned in the intermediate cylinder 50. A stop member 5 is provided on an intermediate portion of the plunger 30. An annular fourth flange 33 is provided in a rear portion of the plunger 30. A first portion 191 and a second portion 192 adjacent to the first portion 191 are provided in the rear section 15 of the chamber 10. Pressurized air passing the port 14 flows to a reservoir 150 for temporary storage in front of the rear section 15 via the second portion 192 and the first portion 191 sequentially. The plunger 30 is stopped from moving rearward when pressurized air reaches the intermediate member 32 of the plunger 30. It is noted that a plurality of sealing rings (e.g., O-rings) are provided in the firing mechanism.

Figure 5:
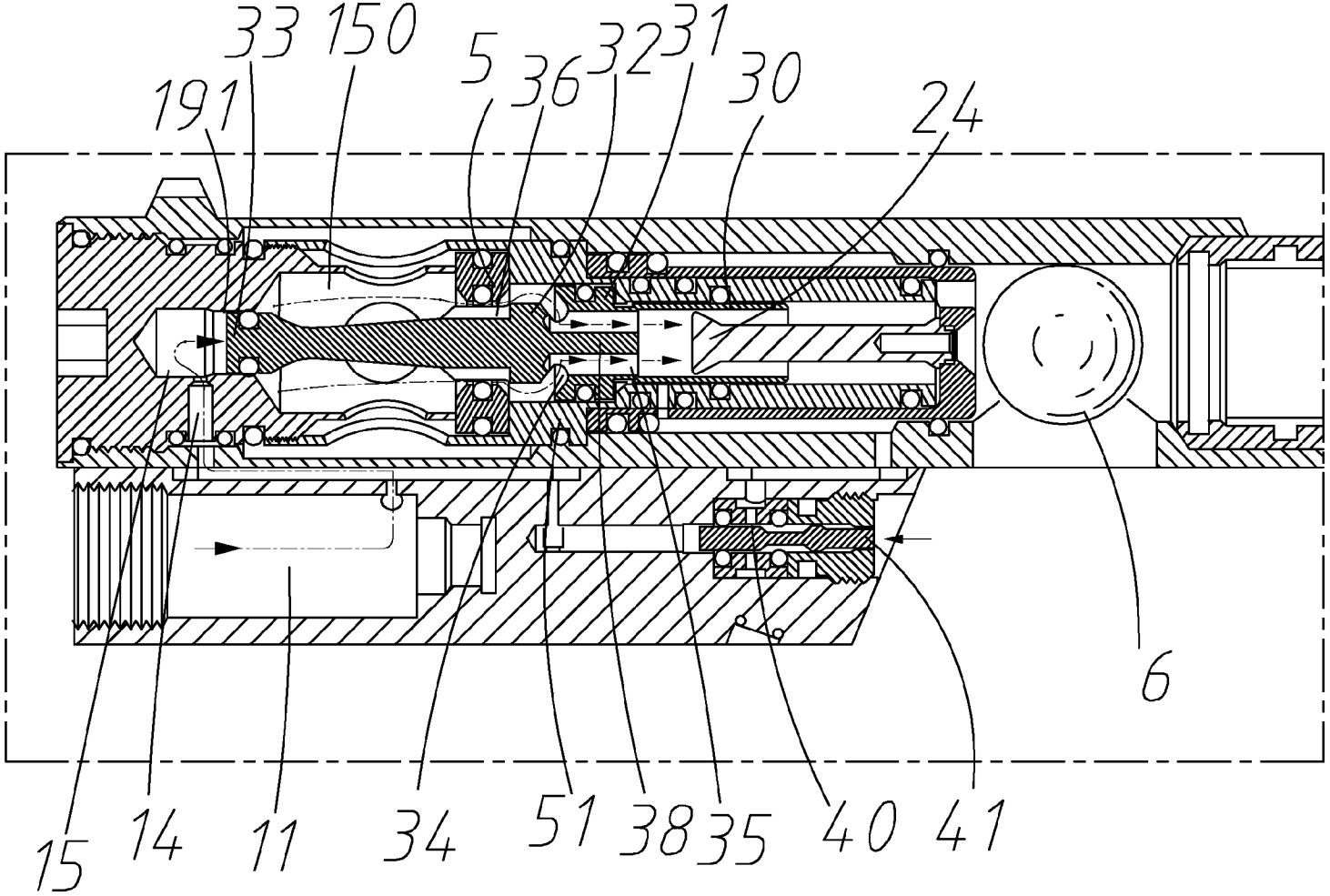
FIG. 5 is a view similar to FIG. 4 where the stem is pushed forward by pressurized air.
Figure 6:
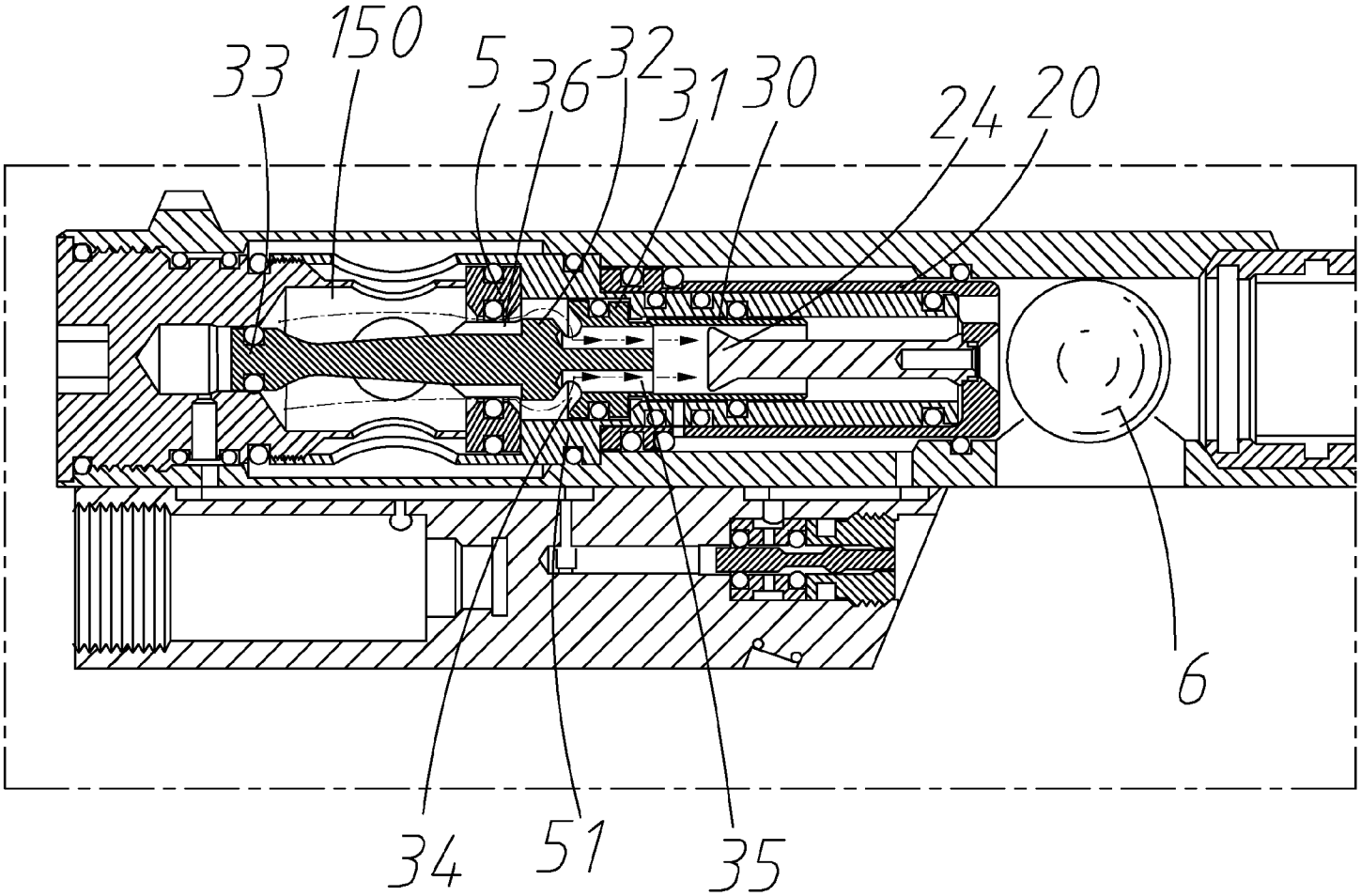
FIG. 6 is a view similar to FIG. 5 where pressurized air is stopped from flowing into the chamber.
Figure 7:
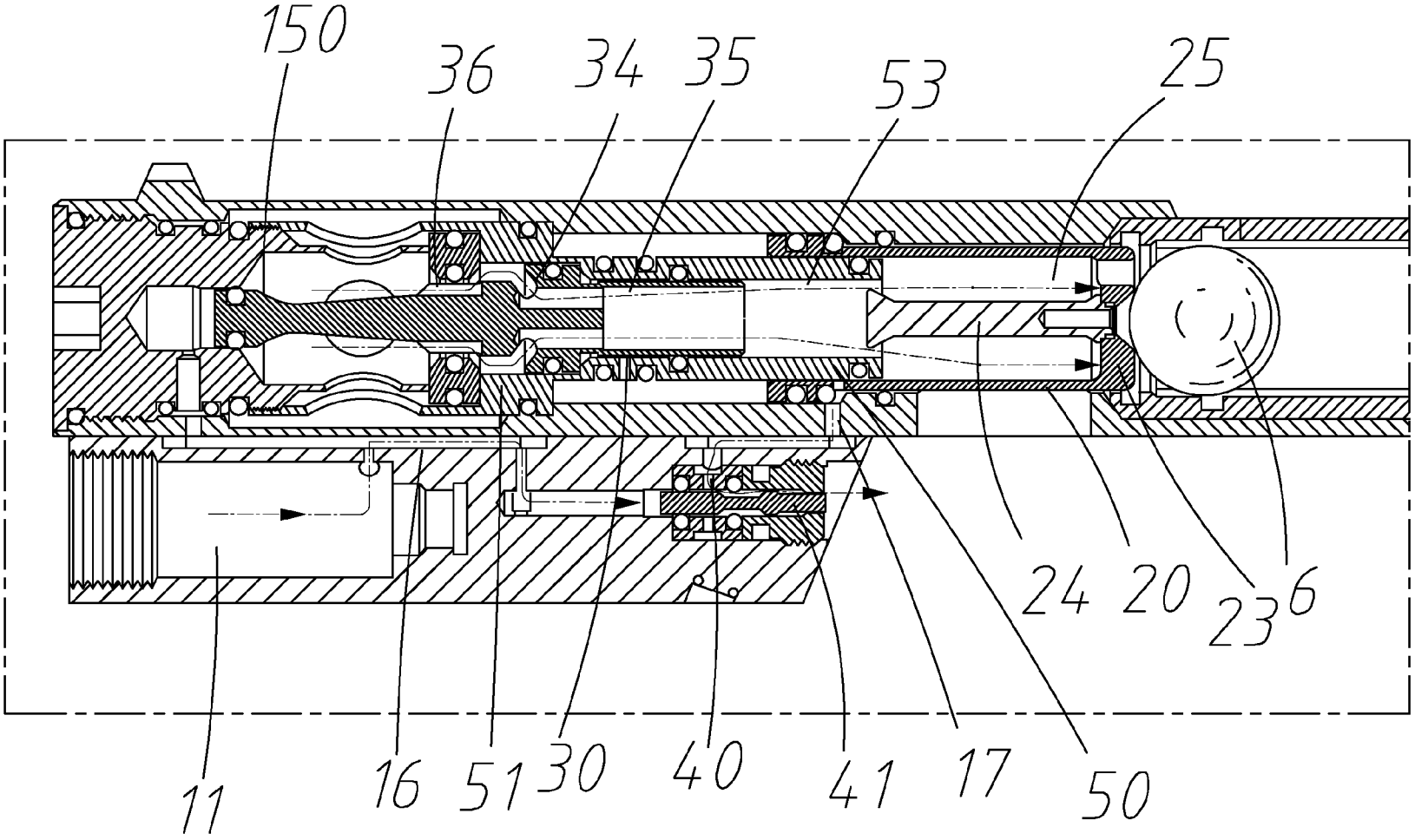
FIG. 7 is a view similar to FIG. 6 where the stem moves forward to a maximum extent prior to firing.
Figure 8:
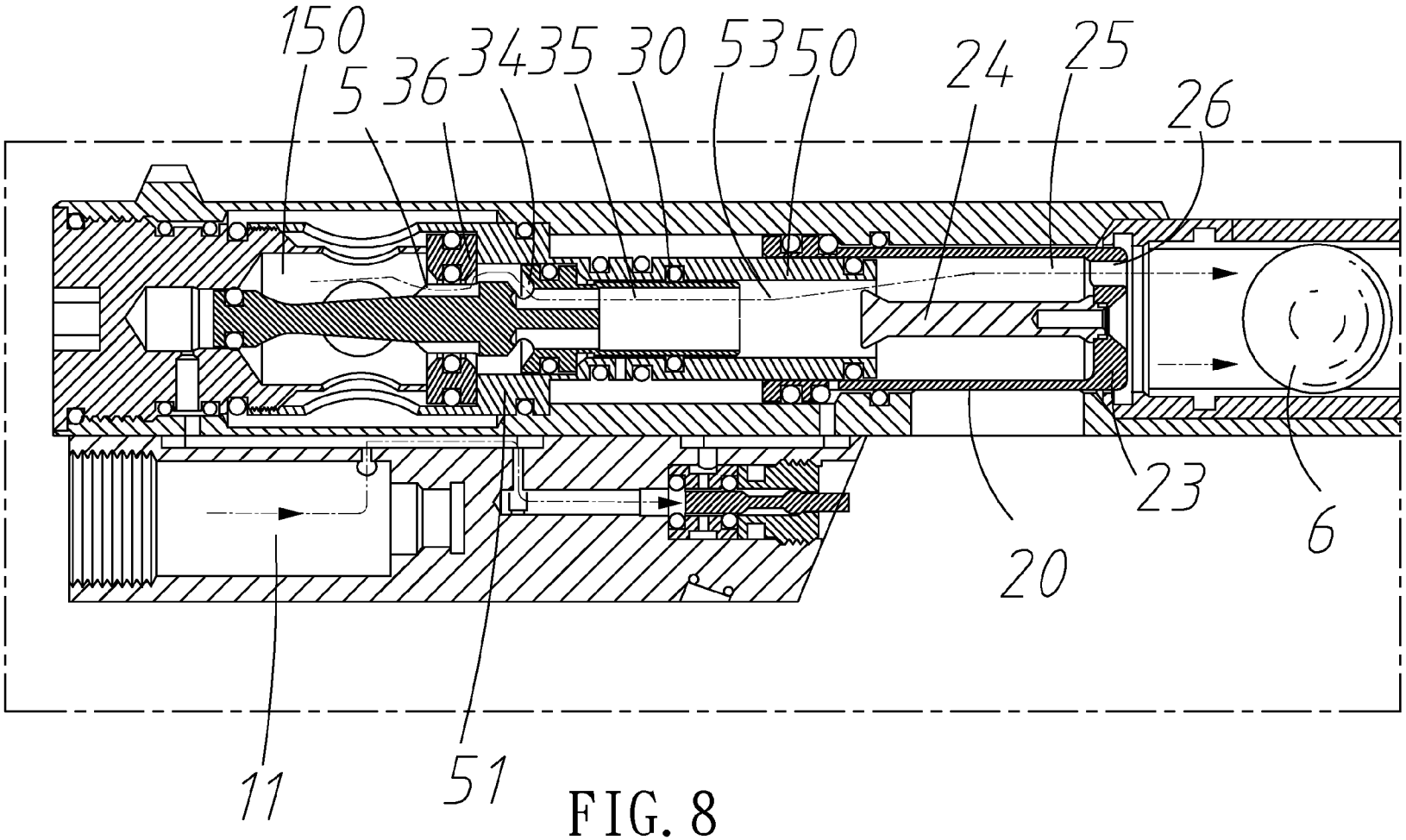
FIG. 8 is a view similar to FIG. 7 wherein the plastic pellet has been propelled out of the gun.

In a firing operation, an individual may press the trigger 3 to push the stem 41 rearward to close the valve 4 and thus block the forward line 16 (see FIG. 5). Pressurized air in the rear section 15 pushes the plunger 30 forward until the port 14 is blocked by the first portion 191. After stopping the plunger 30, pressurized air in the reservoir 150 passes through a plurality of orifices 34 in the fourth flange 33 to reach an annular flange member 38 in a tunnel 35. Next, pressurized air enters the tunnel 35 and then enters a tunnel 53 in the intermediate cylinder 50. A screw 27 is driven through a circular member 23 formed at a forward end of the sleeve 20 into a push rod 24 in a front portion of the chamber 10 to fasten the sleeve 20 and the push rod 24 together. Further, the push rod 24 is disposed in the tunnel 35. Pressurized air pushes the push rod 24 and the sleeve 20 forward. And in turn, the plastic pellet 6 in front of the chamber 10 is pushed to a ready to fire position (see FIG. 7). Pressurized air passes through a space 25 around the push rod 24 in the chamber 10 and then passes through a plurality of holes 26 through the circular member 23. Finally, pressurized air propels the plastic pellet 6 out of the chamber 10 (see FIG. 8). A smooth enlargement 37 is provided on an intermediate portion of the plunger 30 for creating Bernoulli effect. A plurality of fins 36 are formed in rear of the intermediate member 32. As shown in FIG. 7, in response to closing the valve 4 a portion of pressurized air in the chamber 10 and pressurized air between the port 17 and the valve 4 escape to the atmosphere via the port 40.

While the invention has been described in terms of preferred embodiments, those skilled in the art will recognize that the invention can be practiced with modifications within the spirit and scope of the appended claims.

What is claimed is:

1. An apparatus for controlling the firing of an airsoft gun comprising, in combination:

a butt (1) including a chamber (10);

a first line (13) including a first port (12) communicating with a high pressure air canister (60) releasably secured to an underside of the butt (1), and a second port (14) communicating with a rear section (15) of the chamber (10);

a valve (4) disposed under the butt (1) and including a stem (41) and a third port (40);

a second line (16) communicating with the first port (12) and the third port (40);

a third line (42) communicating with the third port (40) and a fourth port (17) in the butt (1);

a firing mechanism (2) disposed in the chamber (10) and including a sleeve (20) and a plunger (30);

a trigger (3) operatively connected to the stem (41);

an annular intermediate member (32) of the plunger (30) positioned in an intermediate cylinder (50);

a stop member (5) disposed on an intermediate portion of the plunger (30);

an annular fourth flange (33) disposed in a rear portion of the plunger (30);

a rear annular first flange (21) of the sleeve (20) disposed on the intermediate cylinder (50) in the chamber (10);

a first portion (191) and a second portion (192) adjacent to the first portion (191) disposed in the rear section (15) of the chamber (10);

a push rod (24) disposed in a front portion of the chamber (10); and a circular member (23) formed at a forward end of the sleeve (20) and releasably secured to the push rod (24);

wherein in a pressurized air supplying operation:

pressurized air leaving the high pressure air canister (60) flows to the rear section (15) of the chamber (10) via the first line (14) and a forward section (18) of the chamber (10) via the second line (16), the third port (40), the third line (42), and the fourth port (17) respectively;

the rear annular first flange (21) of the sleeve (20) is pushed rearward by the pressurized air in the forward section (18) until being stopped by an annular second flange (51) in a rear end of the intermediate cylinder (50);

the pressurized air flows to an annular third flange (31) of the plunger (30) to push the plunger (30) rearward via a fifth port (22) of the sleeve (20) and an orifice (52) of the intermediate cylinder (50);

the pressurized air leaving the rear section (15) of the chamber (10) flows to an adjacent reservoir (150);

the plunger (30) is stopped from moving rearward when the pressurized air reaches the intermediate member (32) of the plunger (30); and a plastic pellet (6) is brought to a front end of the chamber (10); and wherein in a firing operation:

a pressing of the trigger (3) pushes the stem (41) rearward to close the valve (4) and block the second line (16) so that a portion of the pressurized air in the chamber (10) and the pressurized air in the third line (42) exit the valve (4) via the third port (40);

the pressurized air in the rear section (15) of the chamber (10) pushes the plunger (30) forward until the second port (14) is blocked by the first portion (191);

the pressurized air in the reservoir (150) passes through a plurality of orifices (34) in the fourth flange (33) to reach a tunnel (35) in front of the plunger (30);

the pressurized air enters a tunnel (53) in the intermediate cylinder (50);

the pressurized air pushes both the push rod (24) and the sleeve (20) forward;

the plastic pellet (6) is pushed to a ready to fire position in front of the chamber (10) by the pressurized air passing through a space (25) around the push rod (24) and a plurality of holes (26) through the circular member (23); and the pressurized air propels the plastic pellet (6) out of the butt (1) to fire.

* * * * *